US005723169A

United States Patent [19]

Han et al.

[11] Patent Number: 5,723,169

[45] Date of Patent: Mar. 3, 1998

[54] METHOD FOR MAKING A SHADOW MASK FOR A COLOR PICTURE TUBE

[75] Inventors: Dong-hee Han; Hwan-chul Rho; Jae-myung Kim, all of Kyunggi-do, Rep. of Korea

[73] Assignee: Samsung Display Devices Co., Ltd., Kyunggi-do, Rep. of Korea

[21] Appl. No.: 598,387

[22] Filed: Feb. 8, 1996

[30] Foreign Application Priority Data

Nov. 8, 1995 [KR] Rep. of Korea ..... 95-40315

[51] Int. Cl.[6] ..... B05D 5/12; H01J 9/12

[52] U.S. Cl. ..... 427/64; 427/68; 427/74; 313/402; 445/47

[58] Field of Search ..... 427/64, 68, 74, 427/75, 282, 126.3; 313/402; 445/47

[56] References Cited

U.S. PATENT DOCUMENTS

| | | | |
|---|---|---|---|
| 3,885,190 | 5/1975 | Taniguchi et al. | 445/47 |
| 4,442,376 | 4/1984 | Van Der Waal et al. | 445/47 |
| 4,443,499 | 4/1984 | Lipp | 445/47 |
| 4,451,504 | 5/1984 | Gallaro et al. | 427/64 |
| 4,528,246 | 7/1985 | Higashinakagawa et al. | 428/596 |
| 4,629,932 | 12/1986 | Tokita | 445/47 |
| 4,665,338 | 5/1987 | Inaba it al. | 313/402 |
| 4,784,627 | 11/1988 | Van Uden | 445/47 |
| 4,810,927 | 3/1989 | Watanabe | 445/47 |
| 4,884,004 | 11/1989 | Deal et al. | 313/402 |
| 4,983,136 | 1/1991 | Okuda | 445/47 |
| 5,170,093 | 12/1992 | Yamamoto et al. | 313/402 |

FOREIGN PATENT DOCUMENTS

| | | | |
|---|---|---|---|
| 0139379 | 5/1985 | European Pat. Off. . | |
| 403165 | 12/1990 | European Pat. Off. | 445/47 |
| 59-59861 | of 1982 | Japan . | |
| 189538 | 10/1984 | Japan | 445/47 |
| 81139 | 3/1989 | Japan | 445/47 |
| 75132 | 3/1990 | Japan . | |
| 187133 | 8/1991 | Japan . | |

*Primary Examiner*—Benjamin Utech
*Assistant Examiner*—Brian K. Talbot
*Attorney, Agent, or Firm*—Christie, Parker & Hale, LLP

[57] ABSTRACT

Disclosed is a method for making a shadow mask for a color picture tube, including the steps of: forming a pattern, corresponding to apertures of the shadow mask, on a screen mesh fixed to a frame; applying metal paste on the screen mesh having the pattern; disposing a flat AK steel shadow mask under the screen mesh; printing a metal layer on a face of the flat AK steel shadow mask by squeezing the metal paste on the screen mesh with a constant pressure along a direction; and pressing the flat shadow mask to form a skirt portion and a bead portion of the shadow mask.

10 Claims, 4 Drawing Sheets

METHOD FOR MAKING A SHADOW MASK FOR A COLOR PICTURE TUBE

BACKGROUND

The present invention relates generally to a method of forming the anti-doming material of a shadow mask.

A color picture tube of a shadow mask type has electron beams emitted from an electron gun which pass through apertures of the shadow mask to land on R, G and B pixels, respectively, on a phosphor layer.

However, part of the electron beams pass through the apertures of the shadow mask and the rest strike the inner face of the shadow mask to heat it. As a result, the shadow mask thermally expands and domes out, and the position of the apertures is changed against the electron beam. Thus, a demand for compensating the change is proposed.

Referring to FIG. 5, there is illustrated a conventional shadow mask 1 which is secured to a frame 3 which is mounted on a panel by a spring 5.

On the inner surface of the panel 7, there is deposited a phosphor layer containing phosphor pixels that respectively emit light of red R, green G and blue B. The shadow mask 1 is spaced in a predetermined distance from the phosphor layer.

In addition, the shadow mask 1 is generally made of pure iron, for example aluminum killed (AK) steel. This AK steel has a thermal expansion coefficient of about $11.7\times10^{-6}$/K.

When the tube operates, electron beams emitted from an electron gun pass through corresponding apertures of the shadow mask 1 and correctly land on the aimed phosphor pixels to display a picture.

However, about 80% of the electron beams strike the inner surface of the shadow mask to thereby increase the temperature of the shadow mask to about 80°–90° C.

As a result, the shadow mask 1 thermally expands and domes out, as shown in a broken line of FIG. 5, and the paths of the electron beams which pass through the shadow mask shift from the phosphor pixels thereby deteriorating the white uniformity. That is, the path of the electron beam is displaced from position B1 to a position B2 and thereby the corresponding phosphor pixel is also displaced from position P1 to position P2.

To solve the above-described problem, shadow masks made of invar alloy having an extremely low thermal expansion coefficient are disclosed in Japanese Laid-Open Patent No. S59-59861 and U.S. Pat. Nos. 4,665,338 and 4,528,246.

However, invar alloy is difficult to form and the cost thereof is high which increases manufacturing costs.

Therefore, Korean Patent No. 85-1589 discloses a method for forming an electron radiation layer on the shadow mask to solve the doming problem. European Patent No. 139,379 discloses a method for forming a low expansion layer on the shadow mask.

However, since all the methods described above are technically complicated, it is difficult to apply the methods to actual production.

SUMMARY

It is an object of the present invention to provide a method for fabricating a shadow mask for a color picture tube with a much simpler fabrication process while providing low thermal expansion, high electron reflection and a thermal radiation effect.

The above and additional objects are realized in accordance with the present invention which provides a method for making a shadow mask for a color picture tube, comprising the steps of:

forming a pattern, corresponding to apertures of the shadow mask, on a screen mesh fixed to a frame;

disposing a flat AK steel shadow mask under the screen mesh;

printing a low thermal expansion material layer on a face of the flat AK steel shadow mask by squeezing a paste of a low thermal expansion material on the screen mesh with constant pressure along a direction; and pressing the flat shadow mask to form a skirt portion and a bead portion of the shadow mask.

Preferably, the paste comprises one or more metals or an oxide selected from the group consisting of tungsten, carbonated tungsten and bismuth.

According to an important feature of the present invention, the step of printing the layer is performed two or more times to increase the thickness of the layer.

If further printing of the layer on the other face of the flat AK steel shadow mask is required, the process from the step of forming the pattern to the step of printing the layer is applied to the other face of the flat AK steel shadow mask.

According to another important feature, the method further comprises the step of heating the shadow mask, which is obtained after pressing the flat AK steel shadow mask, in a reduction heating furnace to induce substance diffusion of both the material layer and the flat AK steel shadow mask so as to obtain an alloy steel between the layer and the flat AK steel shadow mask.

According to a preferred embodiment, the temperature of the reduction heating furnace is set at about 850°–1,200° C.

BRIEF DESCRIPTION OF THE DRAWINGS

The foregoing and other objects of the present invention will become apparent from the detailed description below when taken in conjunction with the following drawings in which.

DESCRIPTION

While the invention will be described and illustrated in connection with certain preferred embodiments and examples, it should be understood that it is not intended to limit the invention to those particular embodiments and examples. To the contrary, it is intended to cover all alternatives, modifications and equivalents falling within the spirit and scope of the invention as defined by the appended claims.

Reference will now be made in detail to the present invention, examples of which are illustrated in the accompanying drawings. Wherever possible, the same reference numbers will be used throughout the drawings to refer to the same or like parts.

Figure 1:
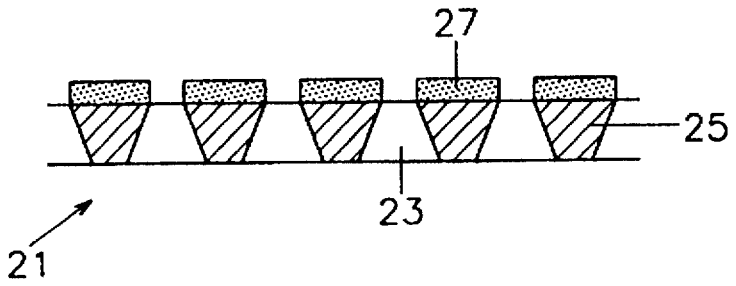
FIG. 1 is a partial sectional view for showing a shadow mask made by a method in accordance with a first embodiment of the present invention.

Referring first to FIG. 1, there is partially illustrated a shadow mask 21 made by a method according to a first embodiment of the present invention.

The shadow mask 21 comprises an AK steel shadow mask 25 having a thermal expansion coefficient of about 11.7× 10–6/K and is provided with a plurality of apertures 23 through which electron beams pass. The AK steel shadow mask 21 is coated on a face facing an electron gun (not shown) with a low thermal expansion material layer 27.

The layer 27 comprises one or more materials selected from the group consisting of tungsten (WC), carbonated tungsten (WC) and bismuth (Bi).

The layer 27 is formed to be less than 50 μm in its thickness and when the beams pass through the apertures, passing characteristic of the beams does not deteriorate.

Referring now to the method for making the shadow mask 21 according to a first embodiment of the present invention in conjunction with FIGS. 2A to 2E, as the first step, a screen mesh 31 made of material selected from the group consisting of stainless steel, polyester and nylon is mounted on a frame 35. And then, photo resist material 33 is covered over the complete surface of the screen mesh 31 in a constant thickness and is then dried (see FIG. 2A).

Figure 2A:
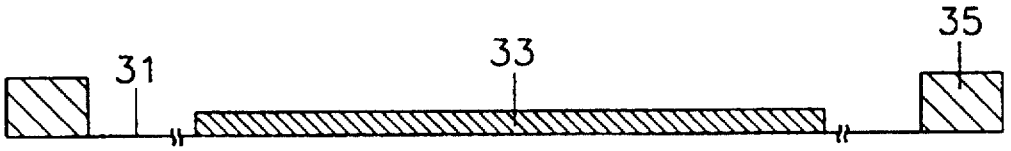
FIG. 2A is a view for showing the first step in a method for fabricating a shadow mask in accordance with a first embodiment of the present invention.
Figure 2B:
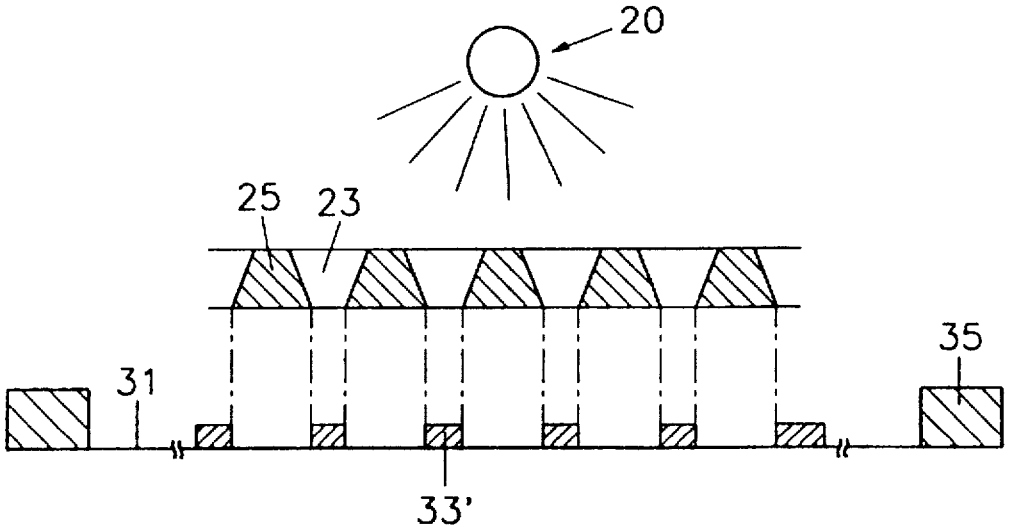
FIG. 2B is a view for showing the second step in a method for fabricating a shadow mask in accordance with a first embodiment of the present invention.
Figure 2C:
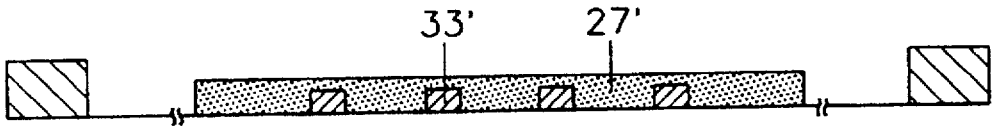
FIG. 2C is a view for showing the third step in a method for fabricating a shadow mask in accordance with a first embodiment of the present invention.
Figure 2D:
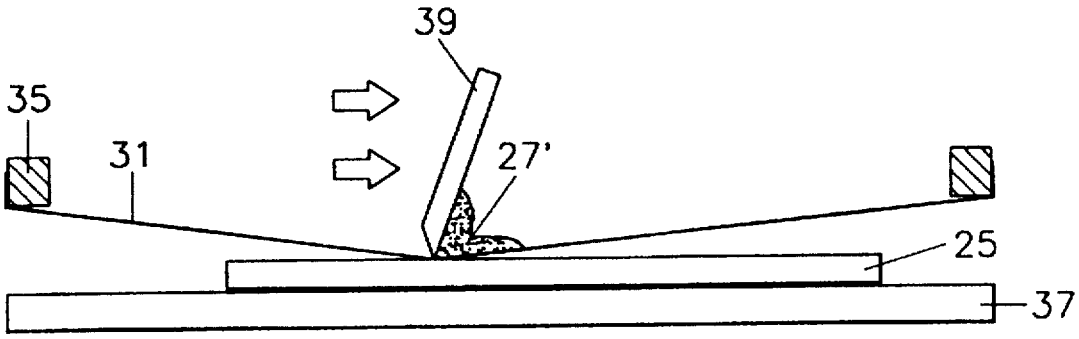
FIG. 2D is a view for showing the fourth step in a method for fabricating a shadow mask in accordance with a first embodiment of the present invention.

In the second step the photo resist material 33 covered on the screen mesh 31 is exposed to light from a light source 20 through the AK steel shadow mask 25 (see FIG. 2B) and the unexposed portion of the photoresist material 33 is etched, thereby, as shown in FIG. 2B, forming photoresist pattern 33' corresponding to the apertures 23 of the AK steel shadow mask 25 as shown in FIG. 2B.

In the third step the screen mesh 31 which goes through the above-described steps is mounted on a screen printer which is well known in the art. And then, metal paste 27' is applied on the upper surface of the screen mesh 31 in a constant thickness (see FIG. 2C). The paste comprises one or more materials selected from W, WC and Bi.

Figure 2E:
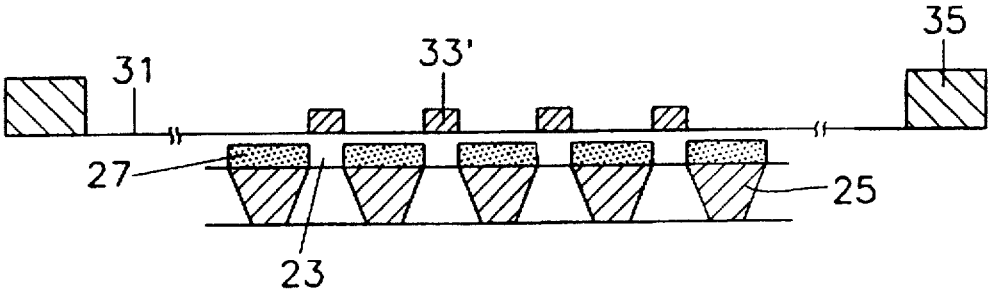
FIG. 2E is a view for showing the fifth step in a method for fabricating a shadow mask in accordance with a first embodiment of the present invention.

In the fourth step the shadow mask 25 is disposed under the screen mesh 31 having the photoresist pattern 33' and the metal paste 27' is then squeezed by a squeeze 39 to thereby be moved in a direction so as to print the metal layer 27 on the AK steel shadow mask 25 (see FIGS. 2D), thereby obtaining the shadow mask 21 as shown in FIG. 2E. This step may be repeatedly performed two or more times, if required, to increase the thickness of the layer 27 or to print another metal material. It is also possible to regulate the thickness of the layer 27 in accordance with the types of screen mesh and paste, and pressure and speed of the printing.

In the fifth step, the shadow mask 25 is pressed thereby to form a skirt portion and a bead thereof, thereby obtaining a finished shadow mask.

The layer 27 made by the above-described steps performs as a low thermal expansion layer as well as an electron reflection layer and thermal radiation layer to suppress doming of the shadow mask 25.

Furthermore, the material used for the layer 27 has a thermal expansion coefficient of less than $4.5\times10^{-6}$/K. This shows that thermal expansion of the shadow can be considerably reduced when considering that the AK steel has a thermal expansion of approximately $11.7\times10^{-6}$/K.

In addition, since each of the materials W, WC and Bi have a relatively high electron-reflection efficiency of about 0.45–0.50, the extinction amount of the electron beams incident to the shadow mask is reduced to thereby suppress doming of the shadow mask.

Finally, each of the materials W, WC and Bi has a relatively high thermal radiation efficiency of about 0.8–0.9, this also helps to suppress doming of the shadow mask.

Figure 3:
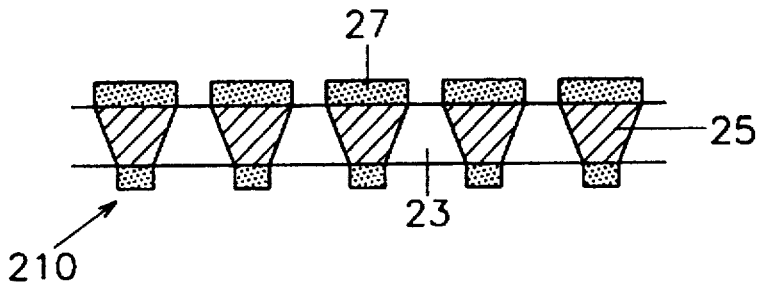
FIG. 3 is a partial sectional view for showing a shadow mask made by a method in accordance with a second embodiment of the present invention.

FIG. 3 shows a shadow mask 210 manufactured by a method according to a second embodiment of the present invention.

The AK steel shadow mask 25 is covered on its opposite faces with the layer 27. To achieve this, before the fifth step of the first embodiment, the first to fourth steps are performed to print the layer on the other face.

Figure 4:
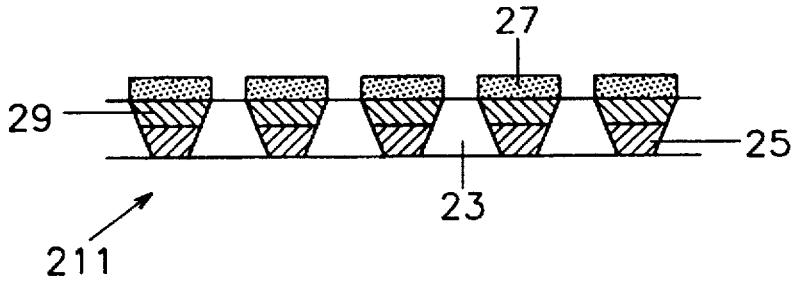
FIG. 4 is a partial sectional view for showing a shadow mask made by a method in accordance with a third embodiment of the present invention.
Figure 5:
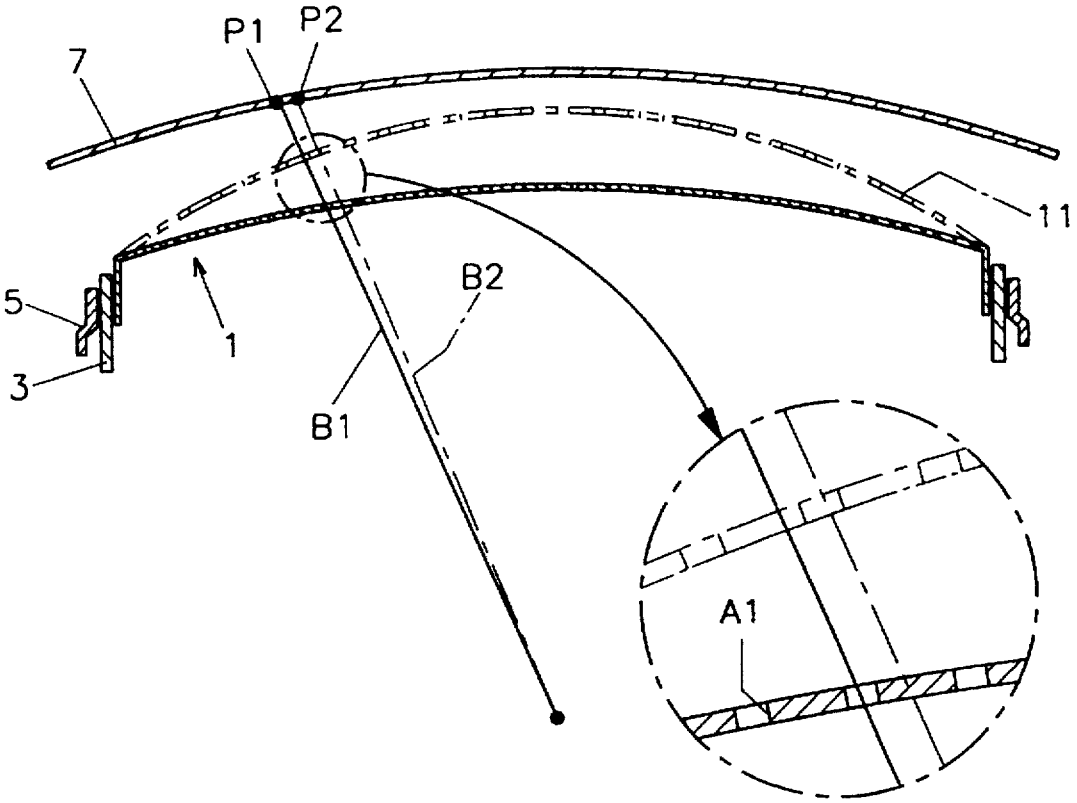
FIG.5 (Prior Art)
FIG. 5 is a sectional view showing a conventional color picture tube.

Referring to FIG. 4 showing a shadow mask 211 made by a method according to a fourth embodiment of the present invention, an alloy layer 29 is formed between the AK steel shadow mask 25 and the layer 27. The alloy layer is formed by substance diffusion of both the layer 27 and the AK steel shadow mask 25.

To form the alloy layer 29 between the AK steel shadow mask 25 and the layer 27, in this fourth embodiment, a cementation process is additionally performed by heating the shadow mask 21 or 210, which is obtained through the first or second embodiment, in a neutral or reduction heating furnace. The temperature of the heating furnace is set at about 850°–1,200° C. because the temperature of the transformation point of the AK steel is approximately 800° C. However, the temperature of the heating furnace may be set at a relatively higher temperature in accordance with the kind of material used.

By this cementation process, between the layer 27 and the AK steel shadow mask 25, substance diffusion occurs resulting in a changing of the inherent characteristic thereof to thereby form the alloy layer 29.

More in detail, the alloy layer 29 comprises alloy steel selected from the group consisting of Fe—W, Fe—WC and Fe—Bi. The alloy layer 29 has a thermal expansion coefficient of about $4.5–11.7\times10^{-6}$/K. This shows that the shadow mask obtained by this fourth embodiment has a lower thermal expansion amount than that obtained by the first or second embodiment.

Further, each of the alloy steels Fe—W, Fe—WC and Fe—Bi has a relatively high thermal radiation efficiency.

What is claimed is:

1. A method for making a shadow mask for a color picture tube, comprising the steps of:

(a) forming a pattern, corresponding to apertures of the shadow mask, on a screen mesh fixed to a frame;

(b) disposing an aluminum killed (AK) steel shadow mask under the screen mesh; and (c) printing a layer on a face of the AK steel shadow mask by squeezing paste material through the screen mesh onto said AK steel shadow mask with a substantially constant pressure along a direction.

2. The method according to claim 1 wherein the paste comprises one or more materials selected from the group consisting of tungsten, carbonated tungsten and bismuth.

3. The method according to claim 1 wherein the layer has a thickness, and the step of printing the layer is performed two or more times to increase the thickness of the layer.

4. The method according to claim 1 further comprising the step of forming a second layer on an opposite face of the AK steel shadow mask by repeating steps (a)–(c) on said opposite face of the AK steel shadow mask.

5. The method according to claim 1 further comprising the step of heating the shadow mask to induce substance diffusion between the layer and the AK steel shadow mask so as to obtain an alloy steel between the layer and the AK steel shadow mask.

6. The method according to claim 5 wherein the step of heating comprises heating the shadow mask at a temperature between about 850°–1,200° C.

7. The method according to claim 1 wherein the step of printing by squeezing comprises the step of squeezing paste material having a thermal expansion coefficient of less than $4.5\times10^{-6}$/K.

8. A method according to claim 1 wherein the step of printing by squeezing comprises the step of squeezing paste material having an electron reflecting efficiency of about 0.45 to 0.50.

9. The method according to claim 1 wherein the disposing step comprises of the step of disposing a flat AK steel shadow mask under the screen mesh.

10. The method for making a shadow mask for a color picture tube, comprising the steps of:

forming a pattern, corresponding to apertures of the shadow mask, on a screen mesh;

disposing a shadow mask under the screen mesh; and printing a layer on a face of the shadow mask by squeezing paste material through the screen mesh onto the shadow mask.

* * * * *

UNITED STATES PATENT AND TRADEMARK OFFICE

CERTIFICATE OF CORRECTION

PATENT NO. : 5,723,169

DATED : March 3, 1998

INVENTOR(S) : Dong-hee Han; Hwan-chul Rho; Jae-myung Kim

It is certified that error appears in the above-identified patent and that said Letters Patent is hereby corrected as shown below:

Column 1, line 43, before "position" delete "a".

Column 3, line 26, replace "consisting of tungsten (WC)," with
-- consisting of tungsten, --.

Column 6, line 6, after "comprises" delete "of".

Signed and Sealed this

Twenty-seventh Day of July, 1999

*Attest:*

Q. TODD DICKINSON

*Attesting Officer*

*Acting Commissioner of Patents and Trademarks*